United States Patent [19]

Montgomery, IV et al.

[11] Patent Number: 4,695,303

[45] Date of Patent: Sep. 22, 1987

[54] METHOD FOR RECOVERY OF NATURAL GAS LIQUIDS

[75] Inventors: George J. Montgomery, IV, Houston; Hafez K. Aghili, Katy, both of Tex.

[73] Assignee: McDermott International, Inc., New Orleans, La.

[21] Appl. No.: 883,210

[22] Filed: Jul. 8, 1986

[51] Int. Cl.[4] ..... F25J 3/02

[52] U.S. Cl. ..... 62/24; 62/34; 62/39; 62/40

[58] Field of Search ..... 62/11, 23, 24, 32, 34, 62/36, 39, 40

[56] References Cited

U.S. PATENT DOCUMENTS

| | | | |
|---|---|---|---|
| 3,675,435 | 7/1972 | Jackson et al. | 62/23 X |
| 3,702,541 | 11/1972 | Randall et al. | 62/24 X |
| 3,929,438 | 12/1975 | Harper et al. | 62/40 X |
| 4,163,652 | 8/1979 | Gazzi et al. | 62/40 X |
| 4,251,249 | 2/1981 | Gulsby | 62/38 X |
| 4,331,461 | 5/1982 | Karbosky et al. | 62/23 X |
| 4,507,133 | 3/1985 | Khan et al. | 62/29 |

OTHER PUBLICATIONS

"Expander-Gas Processing Plant Converted to Boost $C_3$ Recovery", Shuaib A. Kahn, Oil and Gas Journal, Jun. 3, 1985, pp. 6-8.

*Primary Examiner*—Albert J. Makay
*Assistant Examiner*—Steven E. Warner
*Attorney, Agent, or Firm*—Robert J. Edwards; Michael L. Hoelter

[57] ABSTRACT

A method for extracting natural gas liquids from a gas stream that has a high content of hydrogen and carbon dioxide is shown. This gas stream is scrubbed, dehydrated, filtered compressed and chilled prior to entering a demethanizer where the overhead residue gas consisting of hydrogen, nitrogen and methane are separated from the demethanizer bottoms product. Ths bottoms product is then warmed prior to entering a de-ethanizer where ethane, ethylene, and carbon dioxide are separated from the de-ethanizer bottoms product which consists of the heavier compounds of propylene, propane, butane, pentane and the like. The cold demethanizer residue gas is used to cool the incoming inlet gas stream via an inlet gas cooler, and expanded vapor from a high pressure separator is cross exchanged with the de-ethanizer overhead product stream.

6 Claims, 1 Drawing Figure

METHOD FOR RECOVERY OF NATURAL GAS LIQUIDS

FIELD OF THE INVENTION

This invention pertains to a method for recovering natural gas liquids from refinery fuel gas streams and particularly those that have a high inert (hydrogen) content and a high carbon dioxide content.

BACKGROUND OF THE INVENTION

Recovery of natural gas liquids such as ethane, propylene, propane, butylene, butane, and heavier components from refinery fuel gas streams is of economic interest due to the incremental value of the liquid products over the value of the fuel gas. Propylene, butylene, butane, and the heavier components are currently of particular interest due to their having a higher incremental value than ethane or propane.

The presence of carbon dioxide in the fuel gas stream plays a significant role in the percentage of NGL products that are economically recoverable. Generally, the more carbon dioxide in the fuel stream, the more attention that must be paid to both its concentration level and its temperature in order to avoid freezing this carbon dioxide. In many cases involving fuel streams not having a high carbon dioxide concentration, higher recovery is often achievable by lowering the temperature of the process. This however cannot be so easily accomplished with significant amounts of $CO_2$ in the fuel stream due to solid carbon dioxide formation. Removal of the $CO_2$ upstream of the NGL recovery unit may be done with amines (DEA or MEA). This would eliminate the problem of solid $CO_2$ formation in the cold sections of the NGL recovery unit but it would significantly add to the installation and operating cost of the process.

In addition to carbon dioxide, there is often a high molar concentration (30% to 60%) of hydrogen in the refinery fuel gas stream. This hydrogen acts as a non-condensible inert at the normal temperatures and pressures encountered in a typical NGL recovery unit. Consequently, this high molar concentration of hydrogen necessitates higher pressures (800 psi) and lower temperatures (−160° F.) than are required for comparable NGL recovery rates utilizing an inlet gas in which methane is the most volatile component. The presence of $CO_2$ in the hydrogen rich stream serves to limit NGL recovery percentages to even lower levels than would be expected for a methane rich stream.

Another factor which limits economical NGL recovery percentages is the incremental value of the NGL components over that of the fuel. Currently, ethane and propane have low incremental value while propylene, butylene, butane, and the heavier components have a relatively higher incremental value. The ideal process then would reject the low value ethane and propane and recover the high value components. Recovery of the high value propylene, however, forces incidental recovery of the lower value propane because propylene is more volatile than propane. Rejection of the low value ethane in a distillation tower withut a controlled reflux system is impossible without also suffering a partial rejection of the high value propylene. Although rejection of the ethane is feasible in a standard turbo-expander plant, the high hydrogen concentration of the stream forces very low operating temperatures. These lower temperatures are necessary to compensate for the propylene rejection which will occur in the unrefluxed turbo-expander plant de-ethanizer.

A classical reflux system on the de-ethanizer overhead is also not economical due to the low operating temperature level required. The cost of a refrigeration system to provide refrigeration at the required temperature level (approximately −160° F.) would be prohibitive. In addition, if $CO_2$ is present in the process, solid formation at this temperature level may occur, thereby disrupting operation. Several schemes have been proposed which provide a liquid feed to the top of the cryogenic column. These schemes do allow slightly warmer temperatures for comparable recoveries, but are of limited use because the process schemes are not true reflux systems. Furthermore, the flowrate of the liquid feed to the top of the column or the temperature of the stream or both are limited by other process constraints.

Another system that is known is described in U.S. Pat. No. 4,507,133 and also in the article entitled *Expander-Gas Processing Plant Converted,* Oil & Gas Journal, June 3, 1985, written by Schuaib A. Khan with Esso Resources Canada Ltd, Calgary. This system, however, addresses methane-rich gas streams which are wholly lacking in any hydrogen or carbon dioxide concentration. It is exactly the complications arising from the inclusion of hydrogen and carbon dioxide in the fuel supply stream that the present process addresses.

Consequently it is an object of this invention to recover a high percentage of propylene and heavier components without rejection of incidentally recovered ethane and lighter components and to do so with a standard turbo-expander plant without closely approaching the temperature at which solid $CO_2$ is formed. The proposed process uses this method to produce a raw NGL stream with a high percentage recovery of propylene and heavier components. One unique feature of the present process involves sending the raw product to a second distillation unit where ethane and lighter components are rejected. Only a small amount of methane and hydrogen are present in the overhead of the second column. This allows a classical reflux system to be employed with modest refrigeration temperature levels. The rejected ethane from the second column overhead may be mixed with the residue gas from the first column, or it may be condensed and subcooled and used as a top feed to the first column to further enhance recovery levels.

It is another object of this invention to extract natural gas liquids from fuel gas streams that have a high inert (hydrogen) content and a high carbon dioxide content and do so under lower pressures than heretofor been possible and with higher temperatures so as to eliminate the problem of solidifying $CO_2$.

SUMMARY OF THE INVENTION

In accordance with the present invention, natural gas liquids are recovered from a fuel stream high in hydrogen and carbon dioxide content by initially compressing the stream to approximately 300 psi (as compared to 800 psi for more conventional systems) and cooling this stream to around −45° F. Afterwards, this stream is fed to a high pressure separator where the liquid is fed to the lower feed tray of a demethanizer and the vapor is expanded through a turbo-expander causing its temperature to also drop to about −100° F. The expander exhaust is cross exchanged with the de-ethanizer overhead product stream warming the expander exhaust to about −97° F. and cooling the de-ethanizer overhead product stream to about −95° F. The expander exhaust then enters the top of the demethanizer.

The residue gas from this demethanizer (hydrogen, nitrogen, and methane) is removed at a temperature of about −106° F. (as compared to −160° F. with conventional system) and cross exchanged with the inlet gas stream after which this warmed residue gas (approximately 75° F.) is delivered to the refinery fuel system. The demethanizer bottoms product is pumped to a pressure of about 375 psi and then cross exchanged with the inlet gas stream and de-ethanizer bottoms product after which its temperature is raised to about 113° F. before entering the de-ethanizer. The de-ethanizer bottoms product, which is at a temperature of about 160° F., is cross exchanged with the demethanized bottoms product, which is at a temperature of about 75° F., before this de-ethanizer product is delivered elsewhere at a temperature of about 85° F. Some of the top vapors from the de-ethanizer (at about 29° F.) are subsequently chilled to about −94° F. before entering the demethanizer while the remaining protion of these top vapors are recycled back to the de-ethanizer at a temperature of about 22° F.

A refrigeration system is utilized in this process, to aid in the chilling of the inlet gas stream and to provide the de-ethanizer condenser duty.

DETAILED DESCRIPTION OF THE DRAWING

Figure 1:
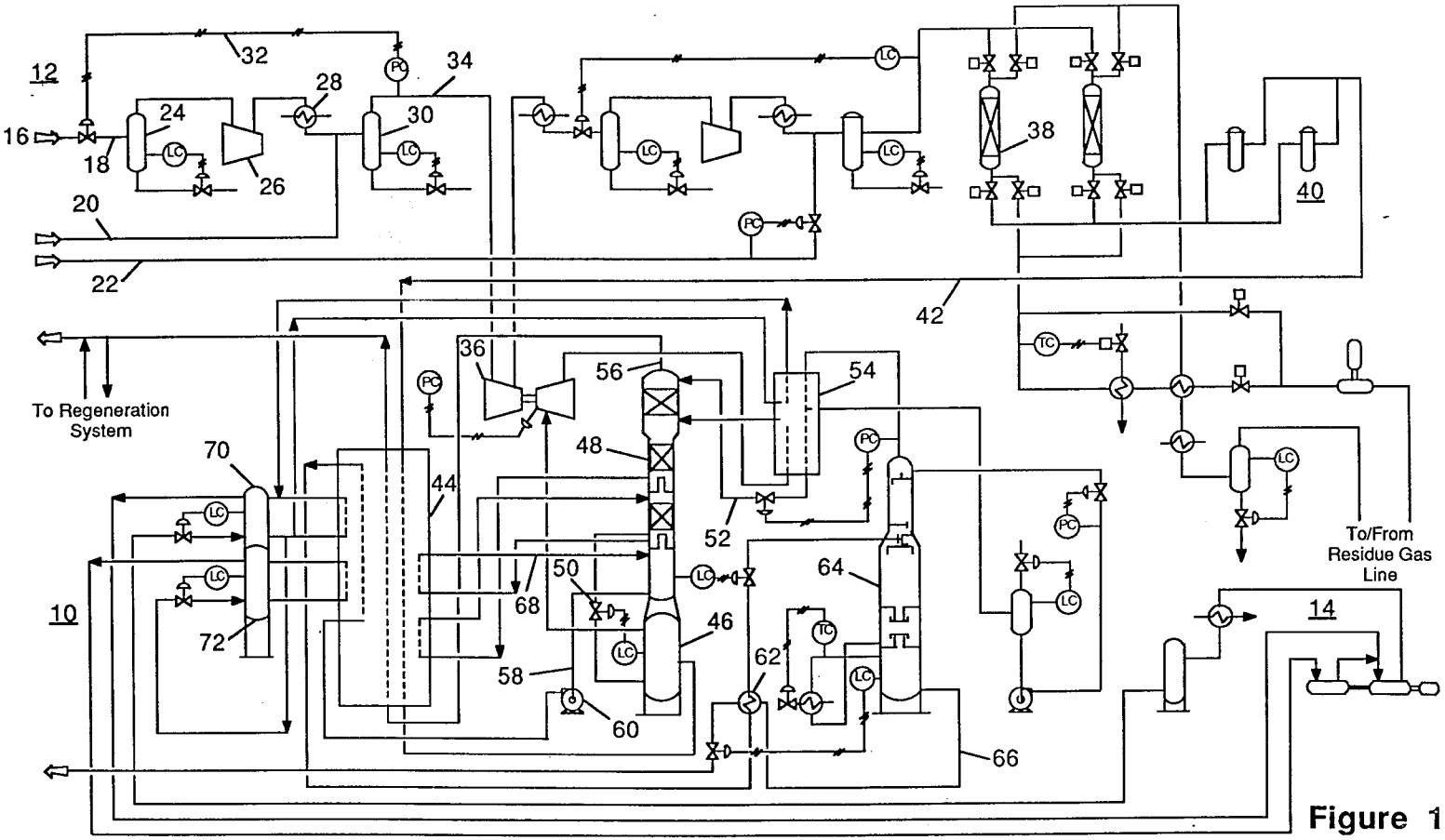
FIG. 1 is a schematic flow chart illustrating the process for recovering natural gas liquids from a fuel stream high in hydrogen and carbon dioxide content.

Referring to FIG. 1, there is shown recovery process 10, compression process 12, and refrigeration process 14. Starting with the initial compression process 12, there is illustrated refinery fuel gas stream inlet 16 which supplies a hydrogen rich gas stream to process 12. This stream generally comprises 40% hydrogen, 40% methane, and 3% carbon dioxide with the remaining 17% being the heavier components of natural gas liquids such as ethane, propylene, propane and the like. As illustrated, inlet 16 includes lines 18, 20, and 22 but other additional lines may be included or, if desired, fewer lines may be so used. Regardless, for the purpose of illustrating this embodiment, these lines can be said to supply this hydrogen-rich fuel stream under a variable pressure of 113 psia to 375 psia and at a temperature of 100° F., although these values may vary.

As shown, inlet line 18 is fed to scrubber 24 where any entrained liquid is removed from the fuel stream. Afterwards, the vapor from this scrubber is compressed by compressor 26 to about 150 psi at 147° F. This vapor is then chilled by heat exchanger 28 before joining line 20 which is at a pressure of 145 psi and entering scrubber 30.

Line 34 transports the vapor from scrubber 30 (to which is fed fuel from lines 18 and 20) to the compressor side of expander/compressor 36 after which this vapor is cooled and scrubbed again. This compression process 12 continues, as shown, till each of lines 18, 20, and 22 have been scrubbed and the pressures is about 315 psi. After this compressed, scrubbed fuel has been dehydrated by dehydrator 38 and filtered by filter 40, it is delivered to the process 10 portion of this schematic by line 42.

Line 42 enters inlet gas cooler 44 where the fuel is chilled from its entering temperature of about 85° F. to its existing temperature of about −45° F. This inlet gas, which is at a pressure of about 300 psi, is then delivered to high pressure separator 46 where condensed liquids are separated from the uncondensed vapors. The liquid from the bottom of high pressure separator 46 flows to the lower feed tray of demethanizer column 48. The pressure of this liquid is reduced from the high pressure separator pressure to the demethanizer pressure across valve 50. In an alternate embodiment, valve 50 may be replaced with a turbine so as to generate power which may be used at various locations in any of processes 10, 12, or 14.

Vapor from the top of high pressure separator 46 flows to the expansion side of expander/compressor 36 where the vapor pressure is reduced from its inlet pressure of about 275 psi to an exit pressure of about 85 psi which is the demethanizer operating pressure. This expanded vapor, which has a temperature of about −104° F., may flow directly to the middle feed tray of demethanizer 48 or it may be first cross exchanged with de-ethanized overhead product stream 52. This cross exchange would occur in de-ethanizer condenser 54 after which this separated vapor would be directed to demethanizer 48 at a temperature of about −97° F.

From demethanizer 48, the top residue gas 56 which consists of hydrogen, nitrogen and methane and which is at a temperature of about −106° F., is then cross-exchanged with the inlet gas stream in inlet gas cooler 44. The exiting temperature of this residue gas, approximately 75° F. and 65 psi, is such that it is delivered elsewhere for subsequent use.

The demethanizer bottoms product 58 which consists of those compounds heavier than methane, flows to bottoms pump 60 which boosts its pressure to the de-ethanizer operating pressure if about 375 psi. This bottoms product 58, which is at a temperature of about −7° F., is also cross exchanged with the inlet gas in inlet gas cooler 44 resulting in an exit temperature of about 75° F. This liquid, which flows through inlet gas cooler 44 upstream of demethanizer 48, then flows through bottoms feed exchanger 62 prior to flowing into the middle portions of de-ethanizer 64.

The de-ethanizer bottoms product 66 which includes propylene, propane, butane, pentane, hexane and the like, leaves de-ethanizer 64 at a temperature of about 160° F. This bottoms product is cross exchanged with demethanizer bottoms product 58 in bottoms feed exchange 62 after which, at a temperature of about 85° F., this de-ethanized bottoms product is transported elsewhere.

De-ethanizer overhead product stream 52 which consists of ethylene, ethane, and cabon dioxide is at a temperature of about 29° F. and a pressure of about 365 psi. This stream travels to de-ethanizer condensor 54 where it is chilled to about −94° F. by being cross exchanged with refrigeration process 14 and with the cold expanded vapor from the expansion side of expander/compressor 36. After this chilling, a portion of de-ethanizer overhead product stream 52 travels to the top of demethanizer 48 while another portion of stream 52 is recycled back to de-ethanizer 64 at a temperature of about 22° F.

Regarding demethanizer 48, packed sections or trays may be employed between feed locations and in the bottoms section. Any number of side heaters 68 may be used, as is necessary, for inlet gas cooler 44 and as economy permits.

Reboiler duty for de-ethanizer 64 may be supplied from an external heating source, such as refrigeration process 14, or from the discharge coolers of inlet gas cooler 44. Side heaters (not shown) may also be employed in the bottoms section of de-ethanizer column to enhance the energy efficiency of the overall process.

A variation of this process is necessary if the inlet feed stream is available at a sufficiently high pressure such that inlet compression by compression process 12 is not required. In this case the energy from the expansion side of expander/compressor 36 may be applied to residue gas 56 compression downstream of inlet gas cooler 44 so as to lower the demethanizer operating pressure. Alternately, the energy may be applied to driving compressors in refrigeration process 14.

Refrigeration process 14 incorporates economizer 70 and low pressure refrigerant drum 72 to aid in cooling the inlet gas flowing through inlet gas cooler 44. This process 14 also aids in cooling de-ethanizer overhead product stream 52 in de-ethanizer condenser 54.

What is claimed is:

1. A method for recovering natural gas liquids from a fuel gas stream with high hydrogen and carbon dioxide content comprising the steps of:

dehydrating said fuel gas stream;

compressing said fuel gas stream to a pressure of generally 300 psi;

chilling said fuel gas stream in an inlet gas cooler to generally −45° F.;

separating said chilled, compressed fuel gas stream into a predominently liquid stream and a predominantly vapor stream;

separately reducing the pressure of said liquid and said vapor streams and supplying said separated streams to a demethanizer;

raising the temperature of said vapor stream prior to supplying it to said demethanizer;

removing cold demethanized residue gas from the top of said demethanizer and cross exchanging said residue gas with said fuel gas stream in said inlet gas cooler to chill said fuel gas stream;

removing cold demethanized bottoms product from the bottom of said demethanizer and cross exchanging said demethanized bottoms product with said fuel gas stream in said inlet cooler to chill said fuel gas stream;

cross exchanging said demethanized bottoms product downstream of said inlet gas cooler and supplying said cross exchanged demethanized bottoms product to a de-ethanizer;

removing a de-ethanized bottoms product from the bottom of said de-ethanizer and cross-exchanging said de-ethanized bottoms product with said demethanized bottoms product to lower the temperature of said de-ethanized bottoms product and raise the temperature of said demethanized bottoms product prior to supplying said demethanized bottoms product to said de-ethanizer;

removing a de-ethanized overhead product from the top of said de-ethanizer and cross exchanging said de-ethanized overhead product with said vapor streams to lower the temperature of said de-ethanized overhead product and raise the temperature of said vapor stream prior to supplying both to said demethanizer; and, scrubbing said fuel gas stream prior to chilling said stream in said inlet gas cooler.

2. The method as set forth in claim 1 further comprising the step of filtering said fuel gas stream prior to chilling said stream in said inlet gas cooler.

3. The method as set forth in claim 2 wherein said fuel gas stream is separated into said predominately liquid stream and said predominately vapor stream in a high pressure separator.

4. The method as set forth in claim 3 further comprising refrigeration as means for reducing the temperature of said fuel gas stream.

5. The method as set forth in claim 4 wherein said fuel gas stream is composed of generally 40% hydrogen, 40% methane, 3% carbon dioxide, and 17% heavier compounds.

6. The method as set forth in claim 5 wherein the initial condition of said fuel gas stream is 300 psi at 85° F.

* * * * *